US006189450B1

(12) United States Patent
Shih

(10) Patent No.: US 6,189,450 B1
(45) Date of Patent: Feb. 20, 2001

(54) INK REFILLABLE STAMP

(76) Inventor: Shiny Shih, No. 31, Lane 349, Chungcheng S. Rd., Yungkang City, Tainan Hsien (TW)

( * ) Notice: Under 35 U.S.C. 154(b), the term of this patent shall be extended for 0 days.

(21) Appl. No.: 09/418,846

(22) Filed: Oct. 15, 1999

(51) Int. Cl.[7] ..... B41K 1/50; B41K 1/52
(52) U.S. Cl. ..... 101/327; 101/125; 101/333
(58) Field of Search ..... 101/103, 109, 101/112, 125, 327, 333, 405, 406

(56) References Cited

U.S. PATENT DOCUMENTS

| | | | | |
|---|---|---|---|---|
| 3,572,243 | * | 3/1971 | Gronau | 101/125 |
| 4,267,772 | * | 5/1981 | Maitland | 101/103 |
| 5,709,145 | * | 1/1998 | Shih | 101/103 |
| 5,855,170 | * | 1/1999 | Shih | 101/333 |
| 6,047,639 | * | 4/2000 | Shih | 101/333 |
| 6,112,662 | * | 9/2000 | Okumura et al. | 101/125 |

FOREIGN PATENT DOCUMENTS

| | | | |
|---|---|---|---|
| 2384627 | * | 10/1978 | (FR) . |
| 11-240234 | * | 9/1999 | (JP) . |
| 11-245495 | * | 9/1999 | (JP) . |

* cited by examiner

*Primary Examiner*—Daniel J. Colilla
(74) *Attorney, Agent, or Firm*—Thorp Reed & Armstrong, LLP

(57) ABSTRACT

An ink-refillable stamp includes a fixed seat, a moving seat slidingly connected to the fixed seat, a top cap secured to the fixed seat, a retaining seat fixed to the bottom of the fixed seat, a spongy pad housed in the bottom of the fixed seat and a printing face mounted to the bottom of the spongy pad. A bottom cover is removeably mounted to the bottom of the fixed seat. At least one ink cartridge is mounted to the fixed seat whereby ink can flow down to the printing face via the spongy pad. When the ink cartridge is empty it is cleanly and conveniently replaced with a new ink cartridge. The cartridge has a scale marked on its transparent body to enable observation of the ink consumption in the cartridge.

5 Claims, 7 Drawing Sheets

INK REFILLABLE STAMP

BACKGROUND OF THE INVENTION

1. Field of the Invention

The present invention relates to an improved ink-refillable stamp, which has ink cartridges detachably provided therein to continuously supply ink for stamping, and when the ink supply is exhausted, the ink cartridges can be easily replaced.

2. Description of Related Art

There are various ink stamps, such as logo stamps, document delivery stamps, C.O.D. stamps, etc. which are commonly used in offices. Conventional ink stamps are applied in conjunction with an independent inkpad which is inconvenient and ineffective. There are two typical types of ink stamp which can be applied directly without an independent inkpad. Both of them have ink supplied in the interior of the stamp. These ink stamps greatly save manpower and increase the labor efficiency. However, a first of the above mentioned two types of stamp can not be used again after the ink stored therein is used up. That means the stamp has to be discarded after the ink supply is exhausted which makes the stamp itself wasted. A second of the above mentioned two types of stamp has a removable top cap provided on the top thereon. When the ink stored in the ink stamp is nearly used up, the top cap can be removed first, and ink can be added via an opening into the stamp. There is still a problem for this kind of ink stamp that the ink added later usually does not spread about evenly on the printing of the ink stamp.

As shown in FIGS. 6 and 7 a conventional ink-refillable stamp of the U.S. Pat. No. 5,855,170 comprises a fixing seat (80), a moving seat (81) movably connected with the fixing seat (80), a top cap (82) securely fixed on the top end of the fixing seat (80), a retaining seat (83) secured on the bottom end of the fixing seat (80) and a bottom cover (84) detachably covering the bottom end of the moving seat (81). The fixing seat (80) has two tubes (801) integrally formed thereon and a positioning post (802) integrally formed thereon at the center between the two tubes (801). The top ends of the tubes (801) and the positioning post (802) respectively extend through a middle partition of the moving seat (81). A spring (803) is provided around the positioning post (802) between the moving seat (81) and a retaining cap (804), which is securely fixed on the top end of the positioning post (802), whereby the moving seat (81) is movably connected with the fixing seat (80). A spongy bed (806) and a printing face (807) are provided in the fixing seat (80) and above the retaining seat (83).

After the bottom cover (84) is removed, a user can hold the top cap (82) to stamp on a plane surface by pushing down on the top cap (82). As the moving seat (81) moves upwards when the user presses the top cap (82), the printing face (807) protrudes from the bottom end of the moving seat (81), so as to print the plane surface.

As best seen in FIG. 7, when the ink is used up, the top cap (82) can be removed to open the tubes (801) of the fixing seat (80). Then the ink is added into the fixing seat (80) via the tubes (801), whereby the ink is absorbed by the spongy bed (806) and spreads about on the printing face (807).

The above ink-refillable stamps have the following defects:

1. when a user is adding ink into the stamp, it is difficult to avoid inking hands of a user;
2. adding an ideal quantity of ink into the stamp is difficult;

3. the ink can not spread evenly in the stamp, so that the quantity and quality of imprints is restricted.

Therefore, it is an objective of the invention to provide an improved ink-refillable stamp to mitigate and/or obviate the aforementioned problems.

SUMMARY OF THE INVENTION

An improved ink-refillable stamp includes a moving seat, a fixed seat, a top cap , a retaining seat, a spongy pad, a printing face, and a bottom cover. At least one replaceable ink cartridge is fitted to the fixed seat whereby when the ink therein is used up it can be cleanly and conveniently replaced with a new ink cartridge. A plurality of orifices allows even flow of the ink from the ink cartridge to the printing face via the spongy pad. The ink cartridge has a scale marked on its transparent body to enable observation of the ink consumption.

Other objects, advantages and novel features of the invention will become more apparent from the following detailed description when taken in conjunction with the accompanying drawings.

DETAILED DESCRIPTION OF THE PREFERRED EMBODIMENT

Figure 1:
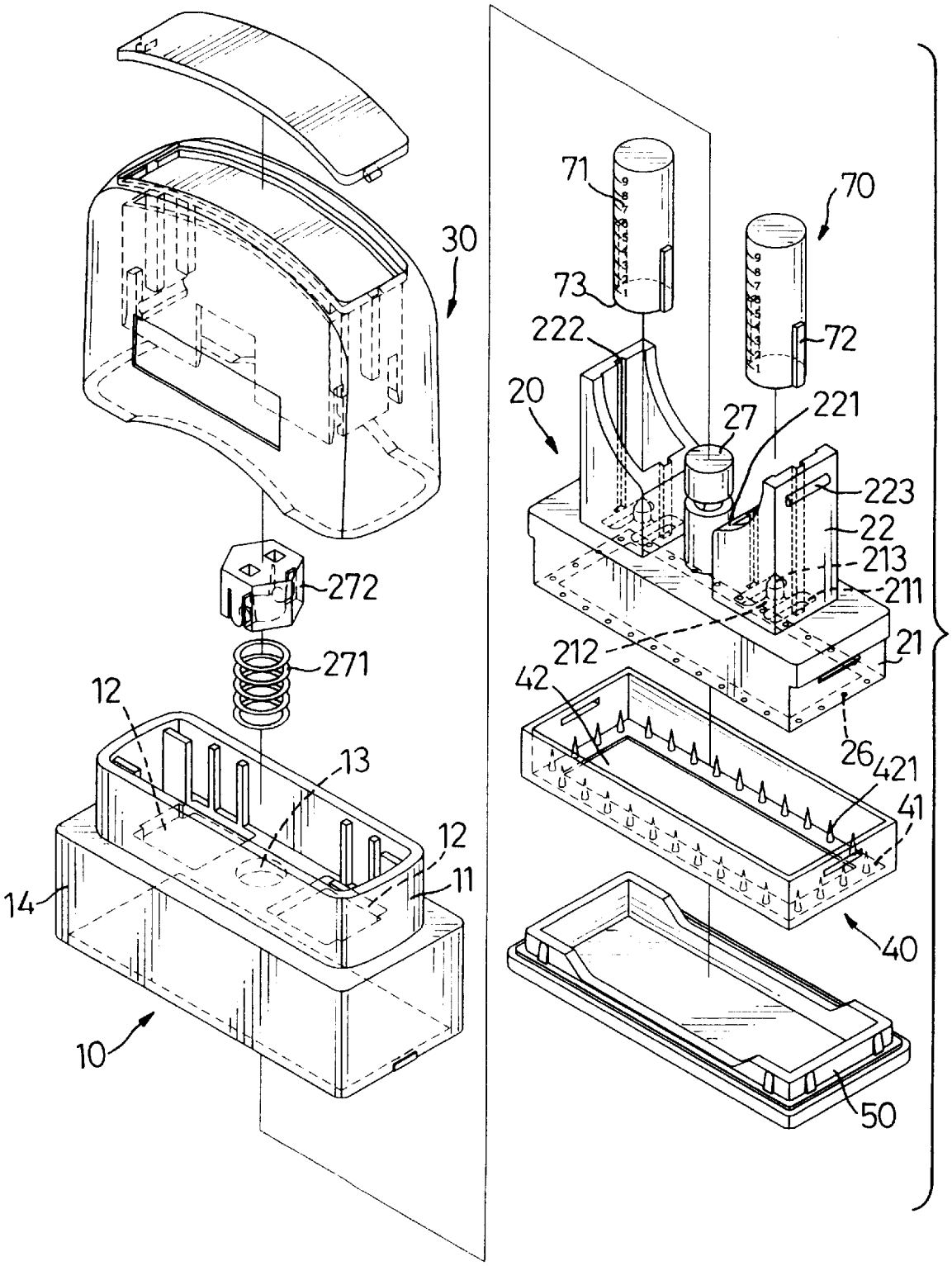
FIG. 1 is an exploded perspective view of an ink-refillable stamp in accordance with the invention.

As shown in FIG. 1, the present invention relates to an improved ink-refillable stamp, which comprises a moving seat (10) movably connected with a fixing seat (.20), a top cap (30) securely fixed on the top end of the fixing seat (20), a retaining seat (40) secured on the bottom end of the fixing seat (20) and a bottom cover (50) adapted for covering the bottom end of the moving seat (10).

The moving seat (10) has a hollow upper portion (11) and a hollow lower portion (14). A partition between the upper and the lower portions (11, 14) defines two passages .(12) and one central through hole (13) between the two passages (12).

Figure 2:
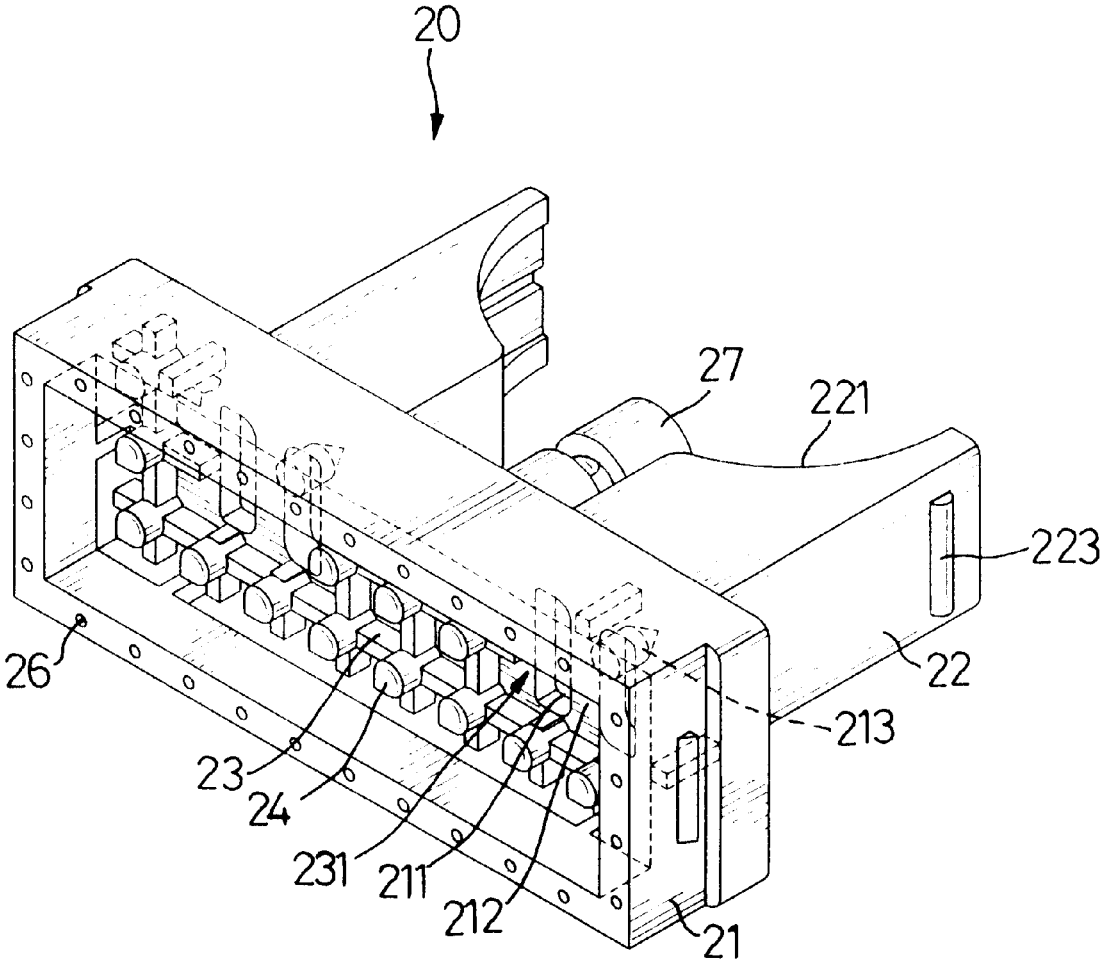
FIG. 2 is a perspective view of a fixing seat of the ink-refillable stamp in accordance with the invention.

Referring to FIGS. 1 and 2, the fixing seat (20) comprises a hollow base stand (21) opened downward with two upright tubes (22) and a positioning post (27) integrally formed on the upper end of the base stand (21) corresponding to the two passages (12) and the central through hole (13) of the moving seat (10). The fixing seat (20) is fitted in the inner space of the lower portion (14) of the moving seat (10). The top ends of the tubes (22) and the positioning post (27) are respectively inserted through the corresponding passages (12) and the central through hole (13) into the upper hollow portion (11). The positioning post (27) has a spring (271)

provided therearound and compressed between the moving seat (10) and a retaining cap (272), which is fixed on the top end thereof. Therefore, the moving seat (10) is movably connected with the fixing seat (20).

The tubes (22) respectively form an inclined surface (221) at the top end thereof, and integrally form a ridge (223) on an outer wall near the top end thereof. Each tube (22) has a bottom opening (211) communicating with the interior of the base stand (21). The tubes (22) each have two opposite inner faces which respectively define one of four longitudinal guide slots (222) therein. A joining portion (212) in the middle of the opening (211) has a spike (213) formed thereon extending upward. The internal bottom of the base stand (21) further defines a plurality of lattice-ordered orifices (23) and channels (231), which communicate with the tubes (22), and forms a plurality of vertical contact pins (24) each with a tip end extending downward.

The periphery of the lower end of the base stand (21) further defines a plurality of equal spaced positioning eyes (26) therein.

Figure 4:
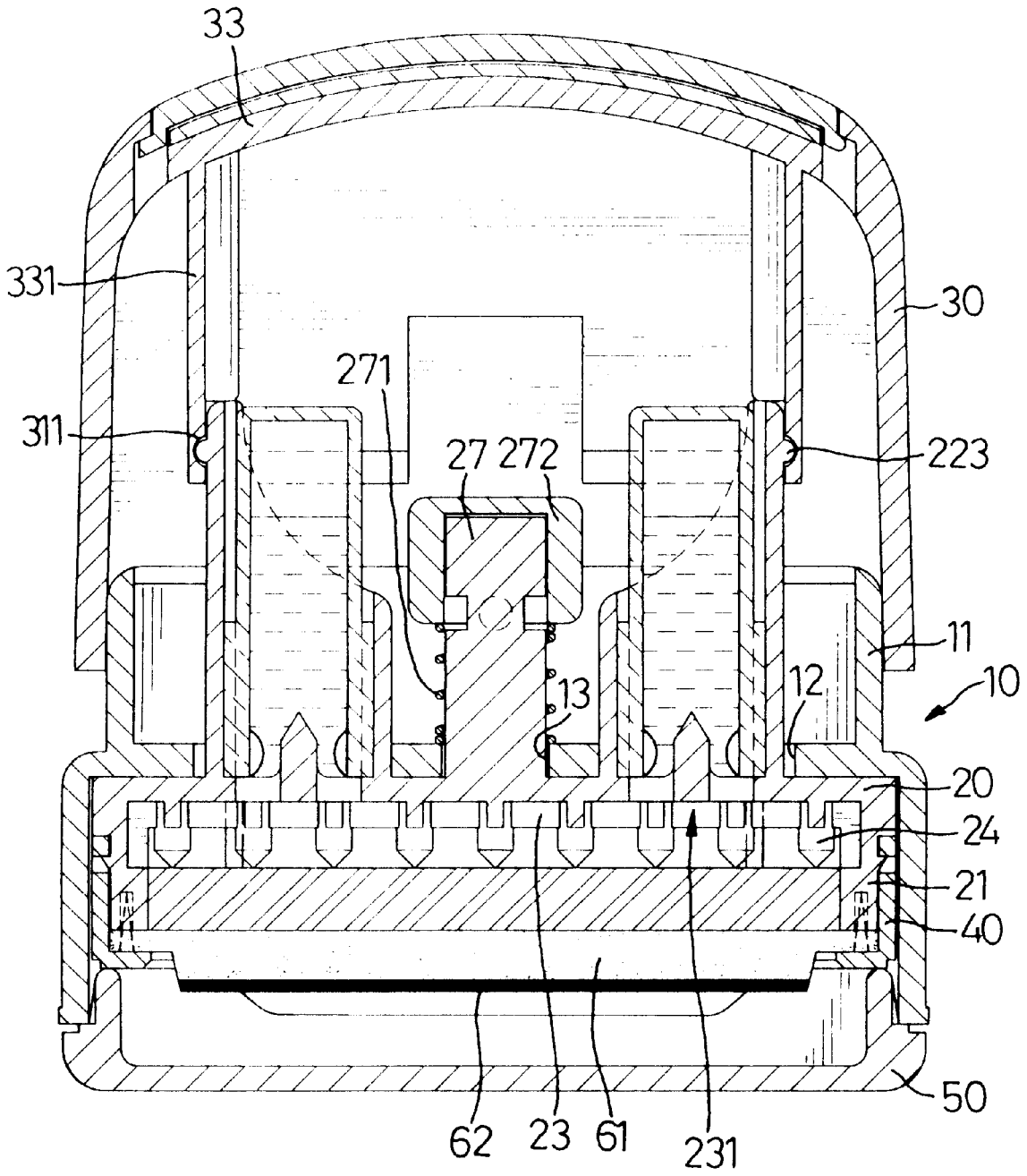
FIG. 4 is a cross sectional view of the assembled ink-refillable stamp in accordance with the invention.

Now referring to FIG. 4, the top cap (30) includes a retaining element (33), which is integrally formed in accordance with the tubes (22) of the fixing seat (20).

The retaining element (33) has two spaced apart legs (331) sized to abut outer faces of the tubes (22). Each leg (331) has an inner face which defines a groove (311) sized to engage with a respective one of the ridges (223) when the tubes (22) are received in the retaining element (33), whereby the top cap (30) is securely fixed on the top ends of the tubes (22).

Figure 5:
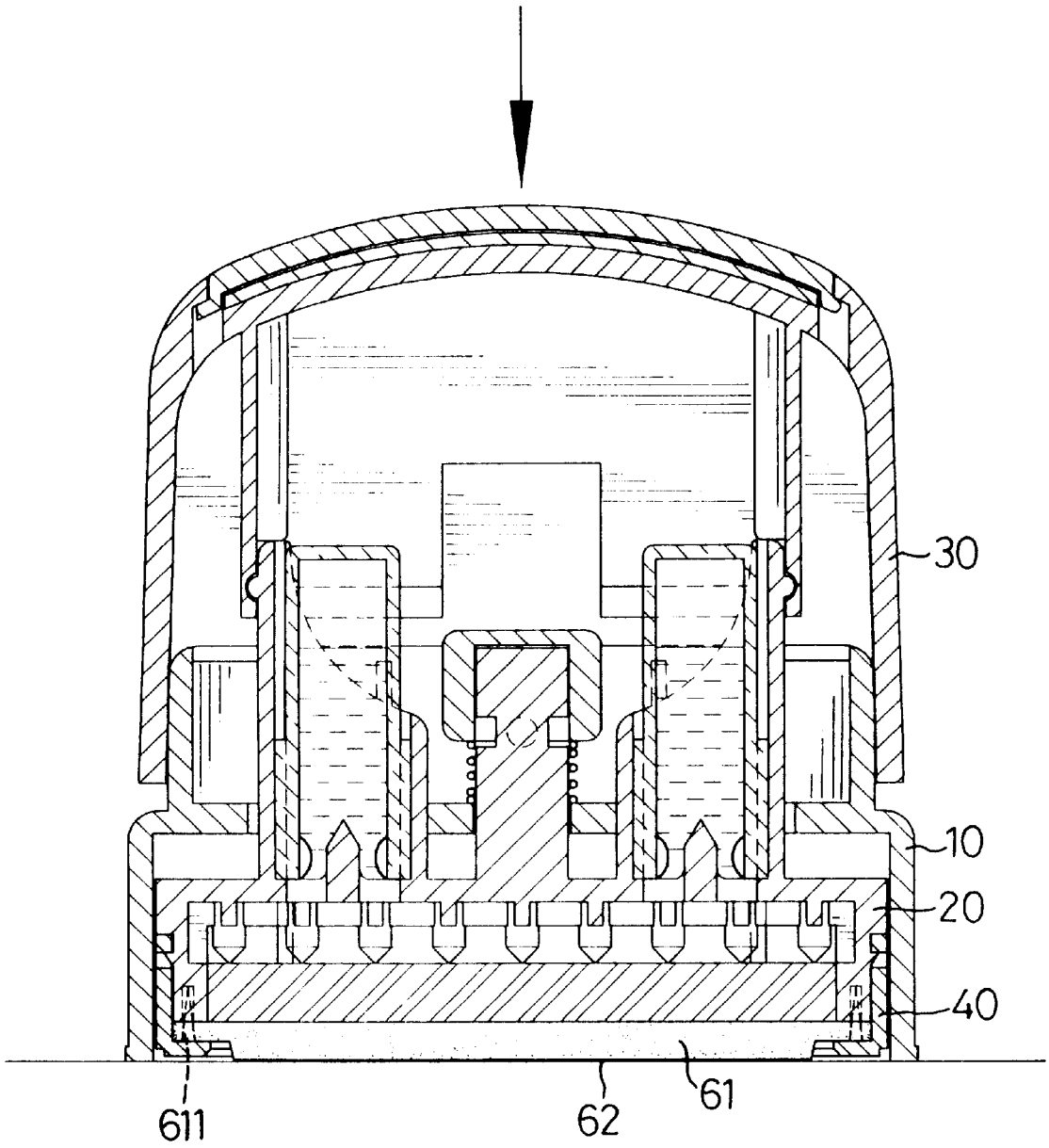
FIG. 5 is a cross sectional view of operation of the ink-refillable stamp in accordance with the invention.
Figure 6:
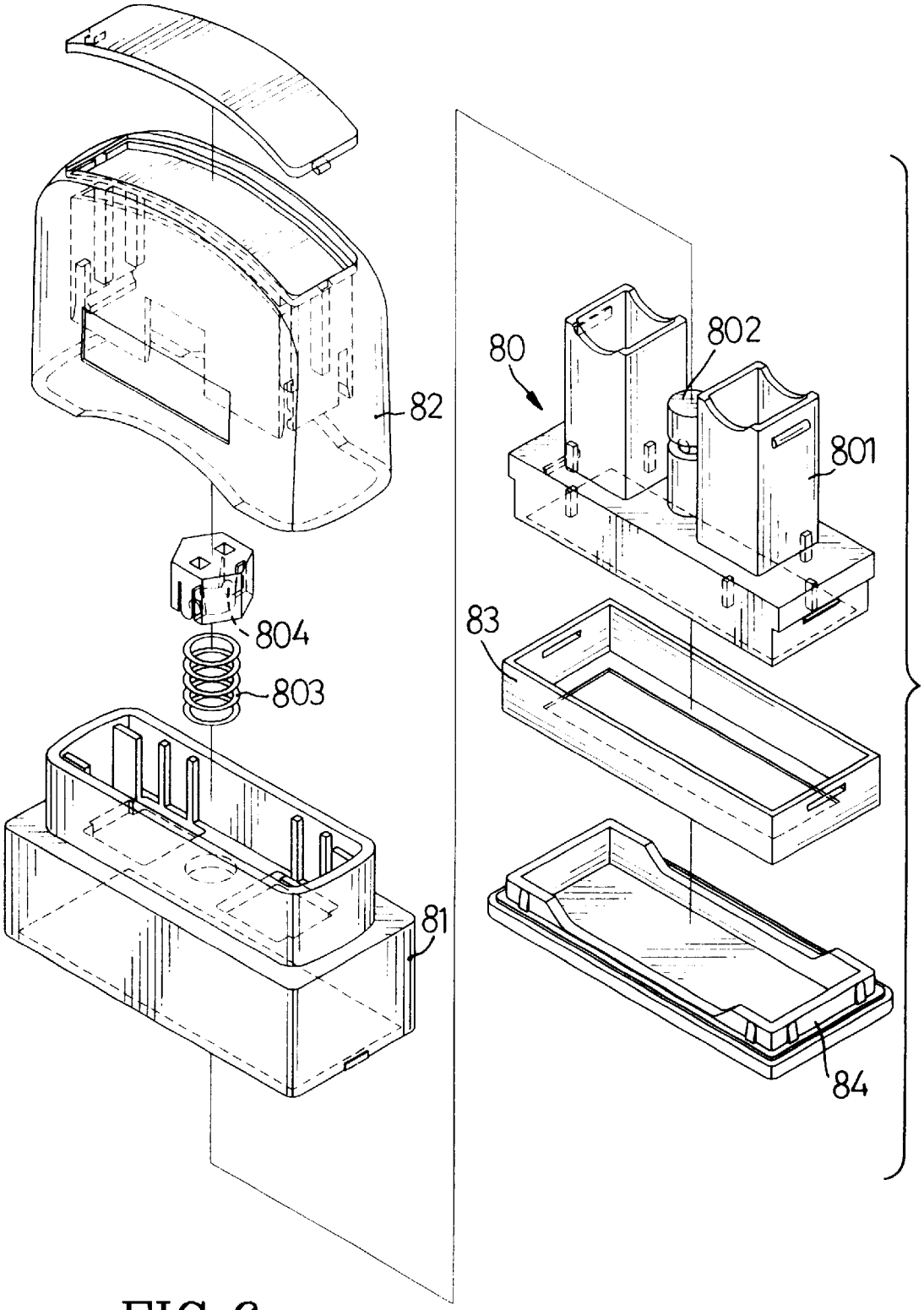
FIG.6 PRIOR ART
FIG. 6 is an exploded perspective view of a conventional ink-refillable stamp.
Figure 7:
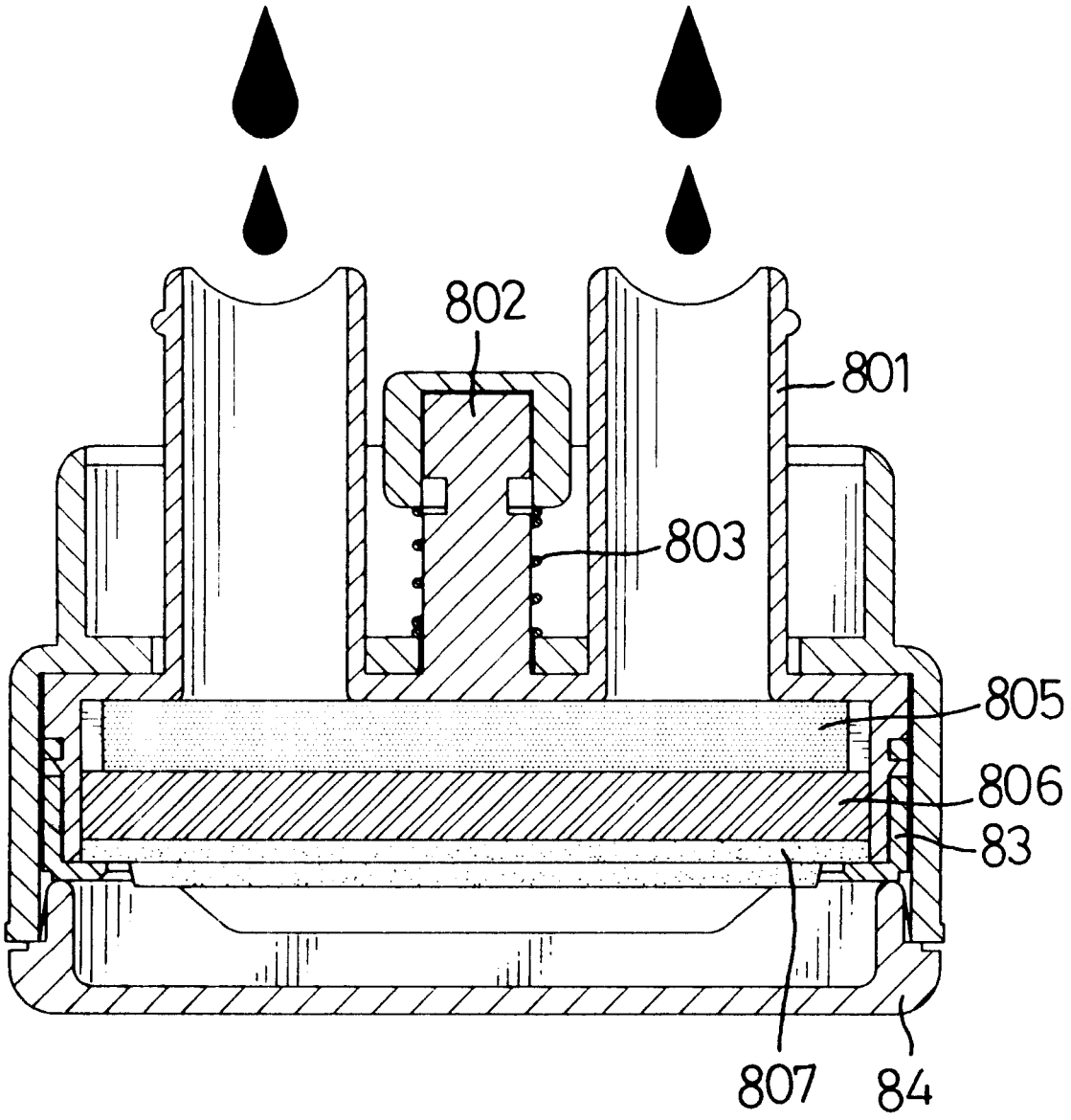
FIG.7 PRIOR ART
FIG. 7 is a schematic view of ink adding of the conventional ink-refillable stamp.

Referring to FIGS. 1 and 5, a spongy bed (61) and a printing face (62) are secured between the contact pins (24) of the fixing seat (20) and the retaining seat (40). The retaining seat (40) includes a peripheral wall (41) and a bottom, which defines an aperture (42) for exposing the printing face (62). A plurality of equal spaced positioning pins (421) is formed on the top face of the peripheral wall (41) and extend upward corresponding to the positioning eyes (26) of the fixing seat (20). The printing face (62) defines a plurality of positioning orifices (611) corresponding to the positioning eyes (26). The positioning pins (421) extend through the positioning orifices (611) of the printing face (62) into the positioning eyes (26) of the fixing seat (20), and a firm retention and positioning of the printing face (62) is effected.

Figure 3:
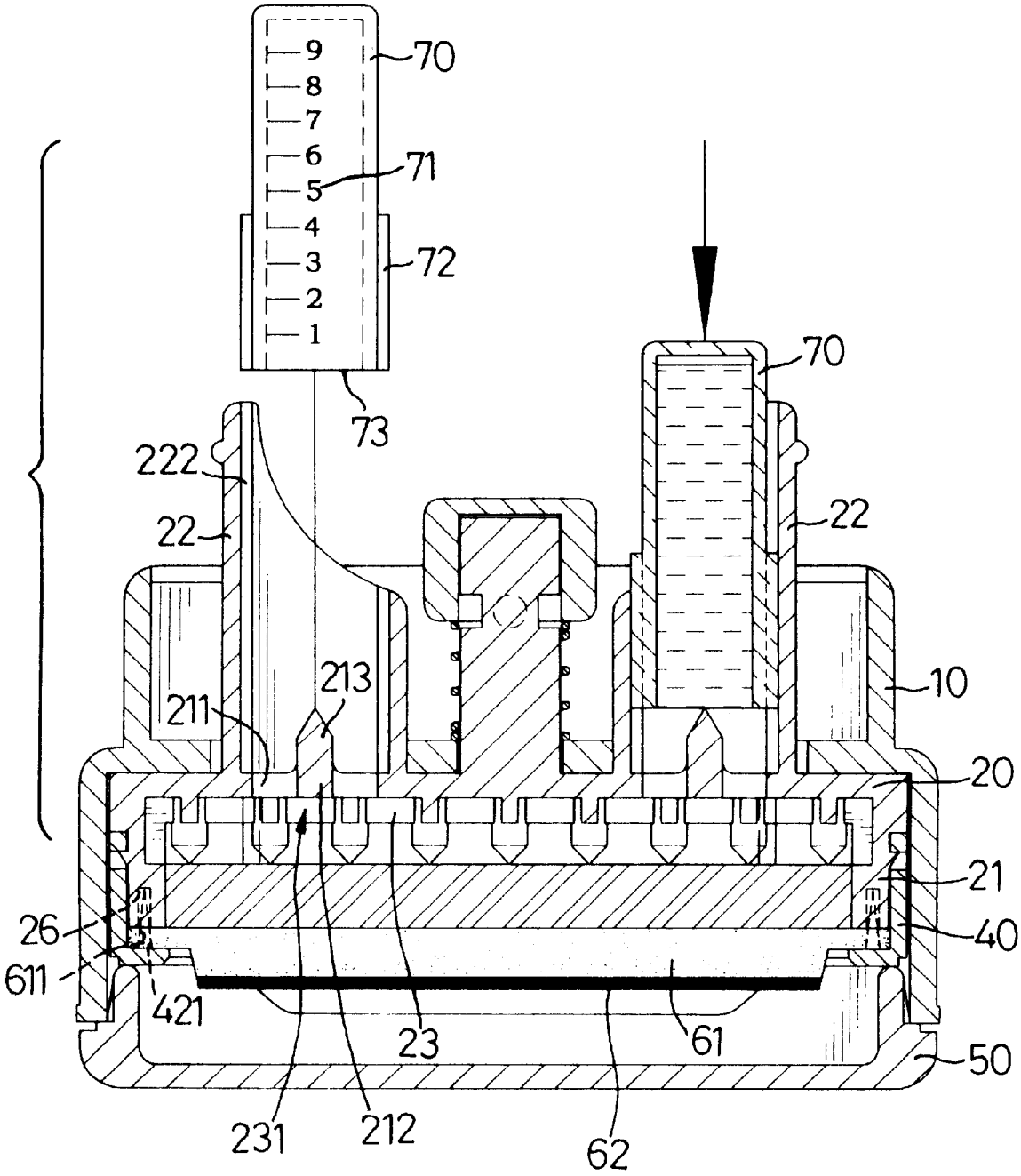
FIG. 3 is a cross sectional view of the ink-refillable stamp in accordance with the invention, showing ink tubes fitted into the fixing seat of the stamp.

As shown in FIG. 3, after removing the top cap (30), two full cartridges (70) are respectively inserted in the tubes (22) of the fixing seat (20). Each ink cartridge (70) is made from transparent material and has a scale (71) printed thereon. Two longitudinal guide tongues (72) are integrally formed on opposite outer side faces of each cartridge (70) corresponding to the two guide slots (222) of each tube (22). Thus the ink cartridges (70) can be secured in the tubes (22) by the guide tongues (72) being fitted in the respective guide slots (222). The ink cartridges (70) and the tubes (22) are respectively identical and so they are referred to in the singular hereafter. A bottom seal (73) of the ink cartridge (70) is pierced by the spike (213) in the bottom of the tube (22). The ink flows through the opening (211) of the tube (22), spreads about in the channels (231) and passes through the orifices (23). Then the ink further spreads about between the tip ends of the equal distributed contact pins (24), whereby the spongy bed (62) absorbs ink evenly.

As shown in FIG. 5, the bottom cover (50) is removed before stamping operation begins. A user can easily hold the top cap (30) to place the ink stamp on a flat surface, and press down the top cap (30) to print the message.

From the above description, it is noted that the invention has the following advantages:

1. the ink stamp can be conveniently and cleanly refilled with ink by replacing spent ink cartridges with new full ones; cartridge
2. the ink consumption can be monitored by viewing the scales on the transparent cartridges;
3. the printing face is securely positioned compared with the conventional art, which increases the print quality of the ink stamp.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved ink-refillable stamp, which comprises a moving seat (10) movably connected with a fixing seat (20), a top cap (30) securely fixed on the top end of the fixing seat (20), a retaining seat (40) secured on the bottom end of the fixing seat (20) and a bottom cover (50) adapted for covering the bottom end of the moving seat (10); wherein the moving seat (10) has a middle partition defined with two passages (12) and one central through hole (13) therein; the fixing seat (20) has a base stand (21) with two upright tubes (22) and a positioning post (27) integrally formed thereon corresponding to the two passages (12) and the central through hole (13); the fixing seat (20) is fitted in the moving seat (10) with the tubes (22) and the positioning post (27) respectively inserted through the corresponding passages (12) and the central through hole (13); the positioning post (27) has a spring (271) provided there around between the moving seat (10) and a retaining cap (272), which is fixed on the top end thereof; wherein the improvements comprises:

each tube (22) has a bottom opening (211) communicating with the interior of the base stand (21), a joining portion (212) in the middle of the opening (211) has a spike (213) formed thereon extending upward, the internal bottom of the base stand (21) further defines a plurality of equal-spaced orifices (23) and channels (231), which communicate with the tubes (22), and forms a plurality of vertical contact pins (24) each with a tip end extending downward;

a spongy bed (61) and a printing face (62) are secured between the contact pins (24) of the base stand (21) and the retaining seat (40);

two ink cartridges (70) are respectively inserted in the tubes (22) of the fixing seat (20), and have bottom end seals (73) thereof pierced by the spike (213) in the corresponding tube (22).

2. The ink-refillable stamp as claimed in claim 1, wherein the tubes (22) respectively form an inclined surface (271) at the top end thereof.

3. The ink-refillable stamp as claimed in claim 1, wherein each tube (22) has two opposite inner surfaces which each define one of four guide slots (222) corresponding to the two guide tongues (72) formed at opposite outer faces of each ink cartridge (70).

4. The ink-refillable stamp as claimed in claim 1, wherein the ink cartridges (70) are made from transparent material and have scales marked thereon.

5. The ink-refillable stamp as claimed in claim 1, wherein the periphery of the lower end of the base stand (21) defines a plurality of equal spaced positioning eyes (26) therein, the periphery edge defining the aperture (42) has a plurality of equal spaced positioning pins (421) formed thereon and extending upward corresponding to the positioning eyes (26) of the fixing seat (20), and the printing face (62) also defines a plurality of positioning orifices (611) corresponding to the positioning eyes (26).

* * * * *